US005078068A

United States Patent [19]

Hager et al.

[11] Patent Number: 5,078,068

[45] Date of Patent: Jan. 7, 1992

[54] PROCESS AND APPARATUS FOR PREPARING A SEAM

[75] Inventors: Walter Hager; Reinhold Dobner, both of Kaiserslautern, Fed. Rep. of Germany

[73] Assignee: Pfaff Industriemaschinen GmbH, Kaiserslautern, Fed. Rep. of Germany

[21] Appl. No.: 623,372

[22] PCT Filed: Apr. 28, 1989

[86] PCT No.: PCT/EP89/00473

§ 371 Date: Jan. 3, 1991

§ 102(e) Date: Jan. 3, 1991

[87] PCT Pub. No.: WO89/12130

PCT Pub. Date: Dec. 14, 1989

[30] Foreign Application Priority Data

Jun. 4, 1988 [DE] Fed. Rep. of Germany ..... 3819059

[51] Int. Cl.[5] ..... D05B 69/18; D05B 69/22; D05B 69/36

[52] U.S. Cl. ..... 112/262.1; 112/273; 112/275; 112/317

[58] Field of Search ..... 112/273, 275, 278, 317, 112/314, 315, 316, 262.1

[56] References Cited

U.S. PATENT DOCUMENTS

| | | | |
|---|---|---|---|
| 4,195,582 | 4/1980 | Novick et al. | 112/317 X |
| 4,336,761 | 6/1982 | Magnan | 112/317 X |
| 4,345,532 | 8/1982 | Eguchi | 112/317 X |
| 4,934,292 | 6/1990 | Mardix et al. | 112/273 |

*Primary Examiner*—Peter Nerbun
*Attorney, Agent, or Firm*—McGlew and Tuttle

[57] ABSTRACT

A processing and sewing machine arrangement for preparing a seam which is uninterrupted on a seam side facing the needle of the sewing machine. The arrangement includes a shuttle thread disturbance detection arrangement and a control arrangement activating a stopping arrangement for stopping the sewing machine after the shuttle thread disturbance has been detected and after a stitch formation cycle which has been begun is completed. A regulating mechanism for setting stitch length is set into a reverse stitching mode by the control arrangement while the fabric being sewn is moved backward by one stitch length. After the shuttle thread has been fed in, thread is knotted by at least one stitch with the needle thread in the same insertion hole in which the old shuttle thread is located such that the old shuttle thread is correctly knotted with the needle thread.

3 Claims, 4 Drawing Sheets

PROCESS AND APPARATUS FOR PREPARING A SEAM

FIELD OF THE INVENTION

The present invention pertains to a process and an apparatus for making a seam which is uninterrupted on a side facing the needle of a sewing machine in which, during the preparation of the seam, the operation of the sewing machine is interrupted in the case of a shuttle thread disturbance and a new shuttle thread is fed in.

BACKGROUND OF THE INVENTION

West German Patent Specification No. DE-PS 2,028,027 discloses a sewing machine on whose housing a guide groove is provided in close proximity to the shuttle, and a cutting device is arranged at the end of the guide groove facing away from the shuttle. The guide groove serves to receive the end of the old shuttle thread coming from the fabric being sewn and, after changing the bobbin, to receive the beginning of the new shuttle thread. After the shuttle threads extending in the guide groove have been shortened by the cutting device, the sewing process is continued, and the new shuttle thread is knotted with the needle thread during the first stitching and pulled to the stitch formation site, while the old shuttle thread is gradually pulled out of the guide groove by the feed motion of the fabric being sewn.

Since the needle thread in the sewing machine is not cut when the shuttle thread has come to its end, a seam whose top side is made without interruption is obtained. However, since the needle thread is connected only to the old shuttle thread at the time of the last stitch prior to the change of the bobbin and only to the new shuttle thread at the time of the first stitch after bobbin change, the lower side of the seam has an interruption, which is a weak point under stress.

SUMMARY AND OBJECTS OF THE INVENTION

It is an object of the present invention to provide a process and a sewing machine for making a seam, in which the needle thread extends uninterrupted and both the knotting with the old shuttle thread and the knotting with the new shuttle thread are to be accomplished in a reliable manner, so that the strength of the seam is not reduced.

According to the invention, a process and sewing machine arrangement are provided for making a seam which is uninterrupted on a side facing the needle of the sewing machine. The arrangement provides that in the case of a disturbance of the shuttle thread during the preparation of the seam, the operation of the sewing machine is interrupted and a new shuttle thread is fed in. The process includes stopping the sewing machine in the position in which the needle is in its bottom most position after the appearance of a shuttle thread disturbance and after the completion of a stitch formation cycle which has already begun. A stitch length regulating mechanism is set for reversing stitching. The sewing machine is then brought into a position in which the needle is in its top position. A stitch length regulating mechanism is then set to zero. After the elimination of the disturbance, at least one stitch is formed to knot the new shuttle thread with the needle thread in the insertion hole in which the needle was located prior to the appearance of the shuttle thread disturbance. Subsequently, stitch formation is continued with the original stitch length.

The apparatus according to the invention provides a sewing machine including means for detecting the appearance of a shuttle thread disturbance and means for stopping the sewing machine in a position in which the needle is in its bottom most position upon the appearance of the shuttle thread disturbance after the stitch formation cycle which has been begun is completed. A control arrangement is provided for setting the stitch length regulating mechanism for reverse stitching subsequent to machine stoppage and the control mechanism brings the sewing machine into a position which the needle is in its top position at which point a stitch length regulating mechanism is set to zero. After the elimination of the thread disturbance, at least one stitch is formed to knot the new shuttle thread with the needle thread in the insertion hole in which the needle was located prior to the appearance of the disturbance and stitch formation is then continued with the original stitch length.

Reversal of the stitch length regulating mechanism to reverse stitching after a disturbance in the shuttle thread causes the fabric being sewn to be moved back relative to the needle to the insertion hole formed prior to the thread disturbance, at which the last regular knotting with the old shuttle thread took place. After feeding in new shuttle thread by pulling thread from the bobbin in the case of double lockstitch sewing machines or from an endless thread reserve in the case of the multiple-thread chain 10 stitch sewing machines following a thread break or after a bobbin change in the case of double lockstitch sewing machines at the thread end, the stitch length regulating mechanism is set to zero, so that the needle thread is knotted one or several times in the same insertion hole with the new shuttle thread, depending on the number of stitches subsequently made. Multiple knotting ensures greater safety against loosening of the knot. Since the old shuttle thread and the new shuttle thread are knotted with the uninterrupted needle thread next to each other in a nearly punctiform area in the insertion hole, this connection point is just as load-bearing as the rest of the seam.

After elimination of the thread disturbances, seam formation is continued by changing over the stitch length regulating mechanism to forward sewing.

The measure according to the invention including knotting the new shuttle thread with a needle thread and subsequently cutting the free ends of the old and new shuttle thread off causes the free ends of the old and new shuttle threads hanging down from the fabric being sewn to be shortened to the extent that they will certainly not be grasped by the shuttle when the seam is continued and will not be bound into the seam.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 6*a*–6*e* are schematic representations of the process steps after a thread disturbance wherein, FIG. 6*a* shows a needle in its lower reversal point in the last insertion hole, FIG. 6*b* shows a needle in its upper reversal point above the penultimate insertion hole, FIG. 6*c* shows a needle during its movement toward the upper reversal point after a repeated insertion into the penultimate insertion hole, FIG. 6*d* shows a needle in its upper reversal point above the penultimate insertion hole after the repeated insertion, FIG. 6*e* shows a needle as seam formation is continued.

DETAILED DESCRIPTION OF THE PREFERRED EMBODIMENT

Figure 1:
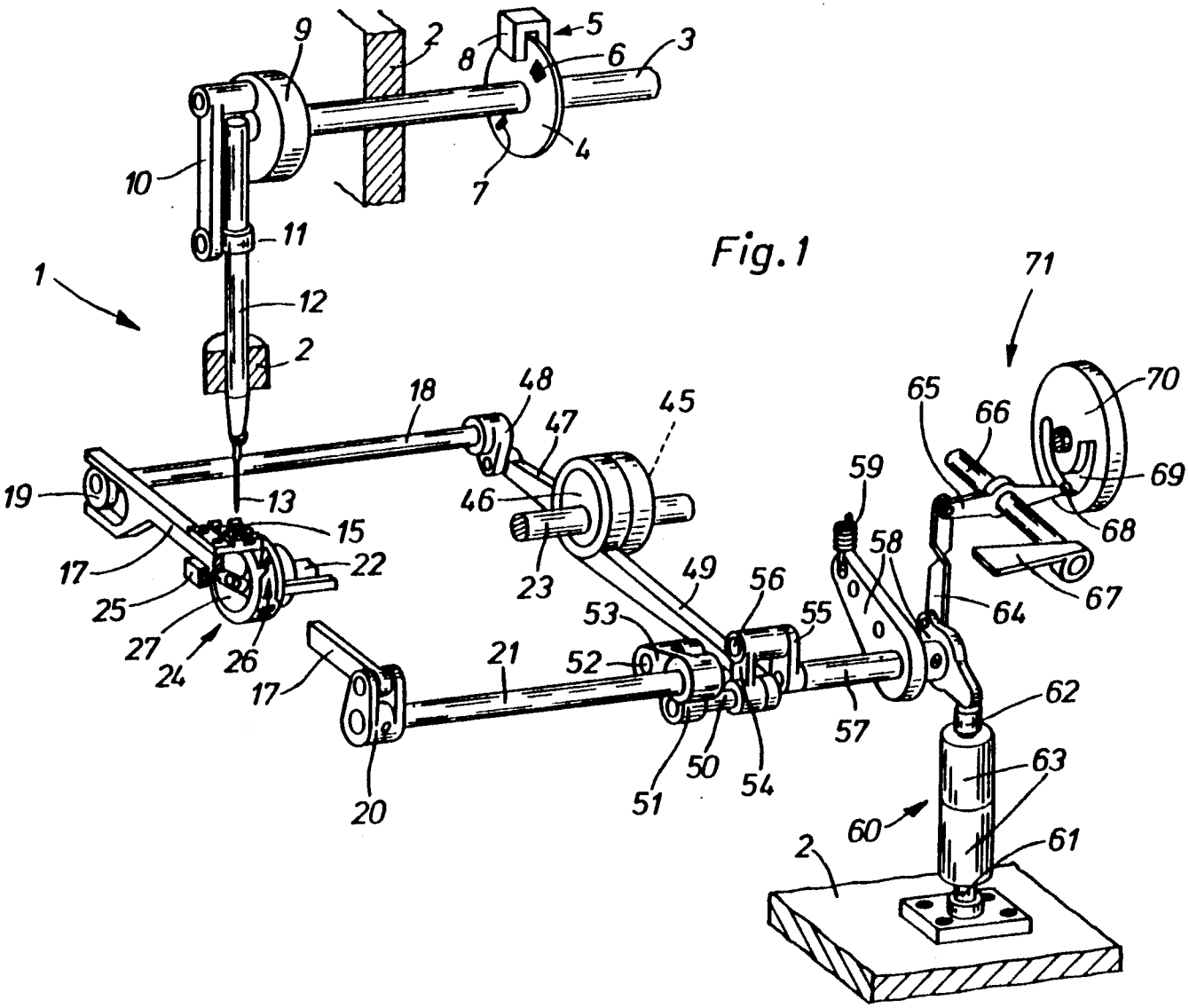
FIG. 1 is a schematic representation of an adjusting and driving parts for the feed dog of a sewing machine according to the invention.

Referring to the drawings and in particular to FIG. 1, a sewing machine 1 with a housing part 2 is provided with an arm shaft 3 mounted carrying an impulse disk 4 of an impulse generator 5. A broader marking 6 and a narrower marking 7, arranged offset from each other, are provided on the impulse disk 4. The markings 6 and 7 can be monitored by a sensor device 8 of the impulse generator 5.

One end of a crank 10 is hinged eccentrically to a disk 9 which is formed in one piece with the arm shaft 3. The opposite end of the crank acts on a needle bar 12 carrying the needle 13 via a clamp 11.

Figure 4:
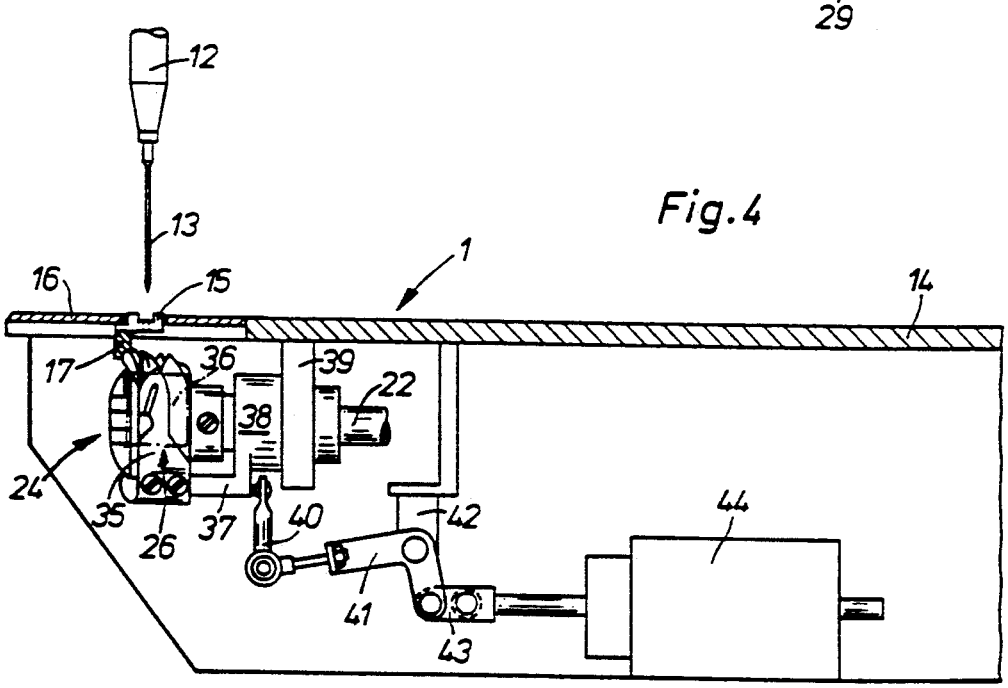
FIG. 4 is a schematic representation of a cutting device according to the invention.

To feed a fabric to be sewn, which is arranged on a base plate 14 (FIG. 4), the sewing machine 1 has a feed dog 15, which extends through slots of a needle plate 16 held by the base plate 14 (FIG. 4). The feed dog 15 is held by a feed dog holder 17 (FIG. 1), whose fork-shaped end surrounds a cam 19 fastened on a shaft 18, and the shaft 18 imparts one lifting movement to the feed dog 15 per stitch formation cycle. The still free end of the feed dog holder 17 acts pivotally on a pin of an oscillating crank 20. The oscillating crank 20 has a fork-shaped design with arms and is arranged on a shaft 21, with which it is forced to rotate, and which imparts one feed motion to the feed dog 15 per stitch formation cycle.

A double lockstitch shuttle 24 is fastened, just under the feed dog 15, on a shuttle drive shaft 22, which is driven in a ratio of 2:1 relative to the arm shaft 3 or a stitch length adjusting mechanism drive shaft 23. A thread monitor 25 and a cutting device 26 are associated with the shuttle 24.

Figure 2:
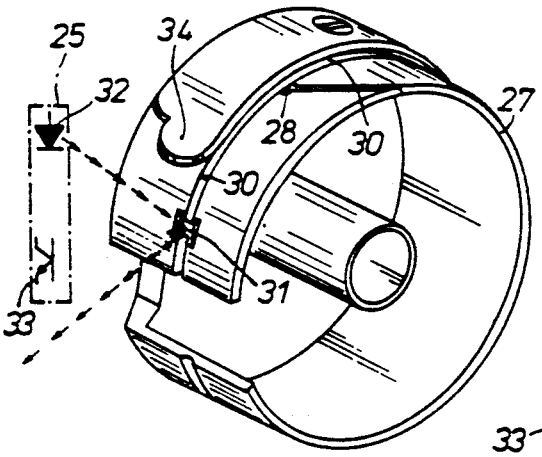
FIG. 2 is a schematic representation of a bobbin case according to the invention.
Figure 3:
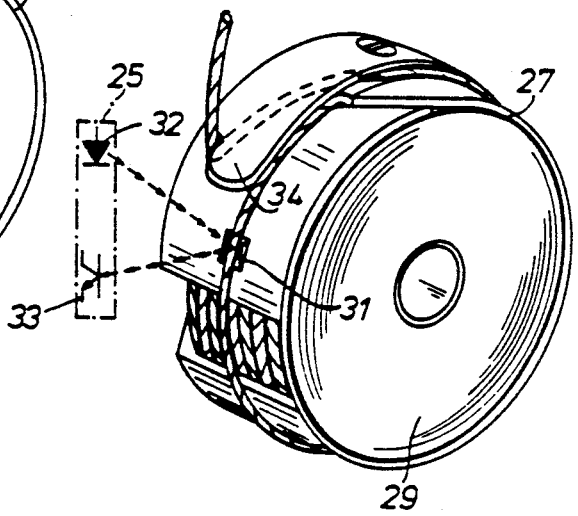
FIG. 3 is a schematic representation similar to FIG. 2, showing the guiding of the thread according to the invention.

The elements necessary for the operation of the thread monitor 25 are shown enlarged in FIGS. 2 and 3. The bobbin case 27 of the shuttle 24 is provided with an annular wall, in which an exit opening 28 for the shuttle thread of a bobbin 29 is provided. The ends of a groove 30, which forms a guide surface and is provided over at least part of the circumference of the bobbin case 27, adjoin the exit opening 28. A deflecting surface 31 for light beams is arranged recessed in the wall of the bobbin case 27. The deflecting surface 31 is provided behind the exit opening 28 in the direction of thread pull and is monitored by a photodiode 32 and by a photodetector 33 of the thread monitor 25, which photodetector is designed as a phototransistor. The deflecting surface 31 is received in the wall of the bobbin case 27 inclined relative to the photodetector 33, and a spring 34 for tensioning the shuttle thread is fastened to the outside of the bobbin case.

The cutting device 26 of the sewing machine is shown enlarged in FIG. 4. The thread catcher 35 of the cutting device 26, provided to grasp the shuttle thread, is arranged coaxially to the shuttle 24 and cooperates with a cutting blade 36 indicated by dash-dotted line, which is arranged on the lower side of the base plate 14. The thread catcher 35 is fastened to a bracket 37 that is connected to a ring 38 loosely surrounding the shuttle drive shaft 22. This ring 38 is mounted, secured in the axial direction and rotatably, in a ring member 39 that is mounted under the base plate 14. A connecting rod 40, which is connected to an arm of an angle lever 41 held by a bearing block 42 attached rigidly to the housing, is hinged to the bracket 37. The other end of the angle lever 41 is connected to the piston rod of a pneumatic cylinder 44 via a connecting rod 43.

Two cams 45 and 46 are arranged nonrotatably on the stitch length regulating mechanism drive shaft 23 (FIG. 1). A cam rod 47 surrounding the cam 45 is hinged at its opposite end to an oscillating crank 48 fastened to the shaft 18. A second cam rod 49 surrounding the cam 46 is hinged to a pin 50, on which a connecting rod 51, which is connected to a crank 53 fastened to the shaft 21 by means of a pin 52, is hinged on a pin 50. Next to the cam rod 49, a connecting rod 54, which surrounds a pin 56 carried by a crank 55, acts on the pin 50. The effective length of the connecting rod 51 is equal to the effective length of the connecting rod 54, so that when the two pins 52 and 56 are aligned, the shaft 21 remains immobile despite the moving cam rod 49.

To vary the movement of the cam rod 49 acting on the shaft 21, the crank 55 is clamped on an adjusting shaft 57. The adjusting shaft 57 carries a two-armed crank 58, on one of the arms of which a tension spring 59 fastened to the housing of the sewing machine 1 acts. The other arm of the crank 58 is in contact with a two-position pneumatic cylinder 60 which has two piston rods 61 and 62 and a cylinder jacket 63 subdivided into two chambers for receiving the piston rods 61 and 62. The piston rod 61 is fastened to a housing part 2, while the piston rod 62 is in contact with the lower side of the arm of the crank 58.

Via a tie rod 64, the crank 58 is connected to one end of an oscillating lever 65, which is fastened to a shaft 66, which is mounted in the housing and carries a switching lever 67. The still free end of the oscillating lever 65 has a spherical projection 68 which extends between side walls of an adjusting groove 69 of an adjusting wheel 70, which is arranged rotatably on an axis that is a rigid part of the housing. The elements 50 through 70 form a stitch length regulating mechanism 71, and the stitch length is adjusted by rotating the adjusting wheel 70 in the known manner.

Figure 5:
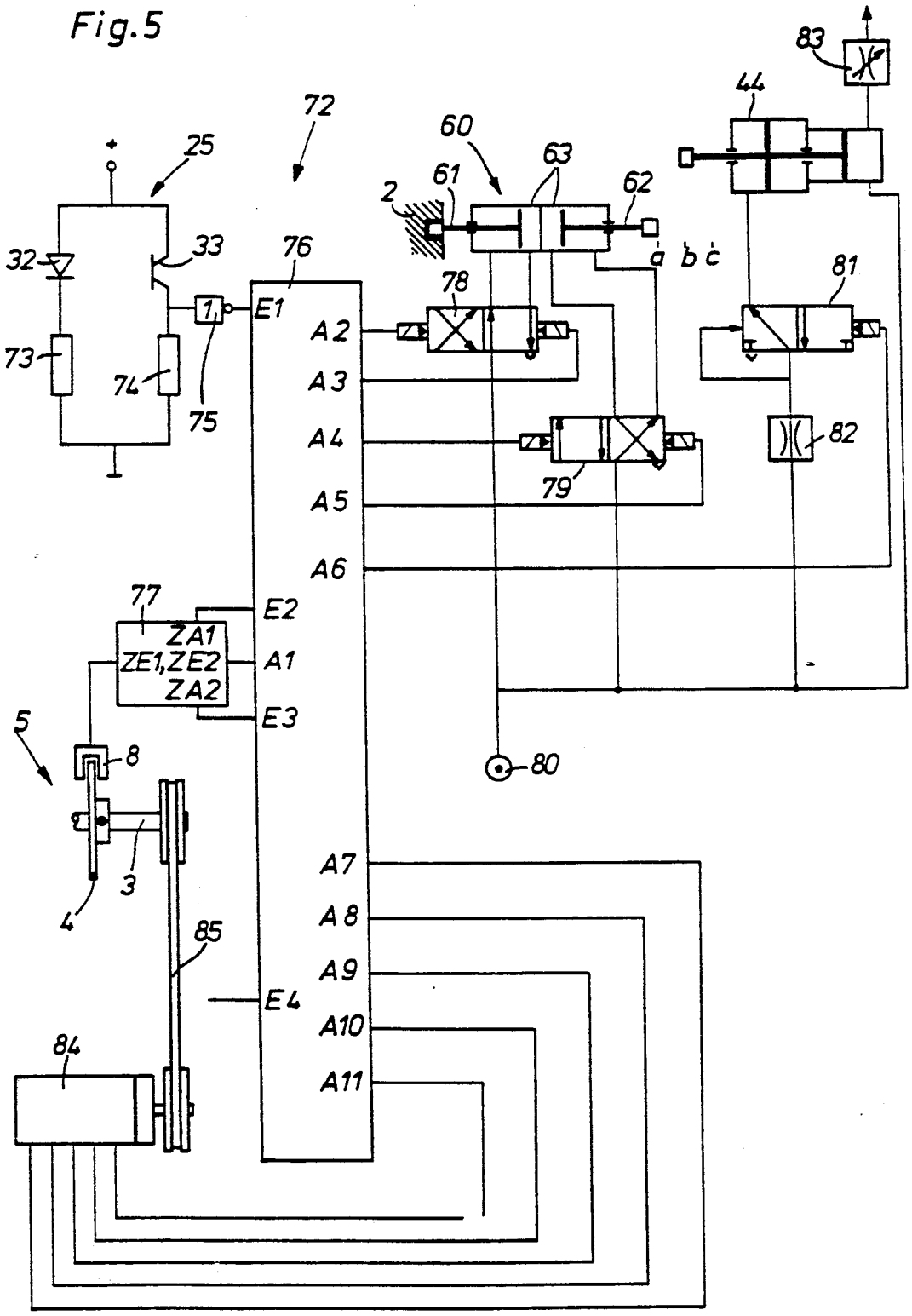
FIG. 5 is a schematic representation of a control device according to the invention.

The sewing machine 1 is provided with a control device 72, which is represented in a simplified form in FIG. 5.

The thread monitor 25 has a stabilized power source, from the positive pole of which current flows via the photodiode 32 and a resistor 73 to the ground. Current also flows from the positive pole of the power source via the phototransistor 33 and a resistor 74 to ground. The emitter of the phototransistor 33 is connected to the input (E 1) of a microcomputer 76 via a NOT element 75.

The sensor device 8 of the impulse generator 5 is connected to the input ZE 1 of a counter 77. This counter 77 has two outputs ZA 1 and ZA 2, of which the output ZA 1 is connected to an input E 2 and the output ZA 2 is connected to an input E 3 of the microprocessor 76. One input ZE 2 of the counter 77 can be reset to zero via a line connected to an output A 1 of the microprocessor 76.

The microprocessor 76 has an input E 4, which can be controlled via a foot pedal (not shown) of the sewing machine 1.

Four more outputs A2 through A5 of the microprocessor 76 are connected to the pressure-switch magnets of two 4/2-way valves via four amplifiers (not shown) and four lines. The directional control valves 78 and 79 serve to admit pressure into the two-position cylinder 60 in a controlled manner and are supplied from a compressed air source 80. One output A6 of the microprocessor 76 is connected via an amplifier (not shown) and a line to the pressure-switch magnet of a 3/2-way valve 81, which is connected to the compressed air source 80 via a throttle 82. One output of the cylinder 44 controlled by the 3/2-way valve 81 is connected to an adjustable throttle 83.

The outputs A7 through A11 of the microprocessor 76 are connected via lines to a known control circuit (not shown) of a positioning motor 84, which is in driving connection with the arm shaft 3 via a belt drive 85.

The device operates as follows:

After exiting from the bobbin case 27, the shuttle thread is led, in at least one turn on its circumference, in the groove 30. The shuttle thread covers part of the deflecting surface 31.

The light beams of the photodiode 32 fall on the shuttle thread and, in the case of a larger deflecting surface 31, on its exposed parts on both sides of the shuttle thread. Due to the inclination of the deflecting surface 31 relative to the photodetector 33, the light beams falling on the deflecting surface 31 are reflected in a direction in which they cannot be received by the photodetector 33. However, part of the scattered light beams reflected by the shuttle thread reaches the photodetector 33.

Due to the scattered light beams, the photodetector 33 is conductive, and current flows to the ground through the resistor 74. The voltage thus occurring on the emitter is transmitted to the NOT member 75, whose output carries no voltage as long as the photodetector 33 is conductive. However, when the shuttle thread is broken or has been consumed to the extent that the deflecting surface 31 is exposed, light beams will no longer reach the photodetector 33. While a signal is no longer present at the input of the NOT member 75 as a result of this, a signal is available at its output and is sent to the input E1 of the microprocessor 76.

The signal of the thread monitor 25 causes the microprocessor 76 to send a signal from its output A7, by which the working speed of the positioning motor 84 is reduced to a markedly lower speed. At the same time, the inputs E2 and E3 of the microprocessor 76 receive the signals sent from the counter 77 of the impulse generator 5.

The counter 77 is put into operation by the entry of one of the markings 6 and 7 into the monitoring zone of the sensor device 8, and its input ZE1 receives a signal until the marking 6, 7 leaves the monitoring zone. As long as the signal is present at input ZE1, the counter 77 counts up beginning from zero, and a higher value is associated with the marking 6, which indicates the lower reversal point of the needle bar 12, than with the marking 7, which indicates the upper reversal point of the needle bar 12. The counter 77 sends a signal to the microprocessor 76 from its output ZA 1 when the higher value is reached and from its output ZA 2 when the lower value is reached. After each signal received by the microprocessor 76 at its inputs E2 or E3, the microprocessor sends a signal from its output Al, as a result of which the counter 77 is reset to zero.

Figure 6A:
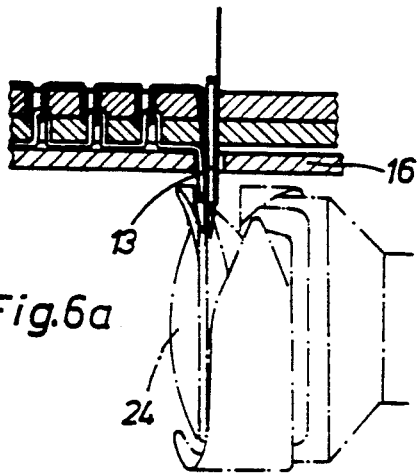

When the signal of the counter 77 first arrives at the input E2 of the microprocessor 76, it sends a signal from its output A8, as a result of which the needle 13 is stopped in its lower reversal point in the last insertion hole in the fabric being sewn (FIG. 6*a*). When the needle 13 stops, the microprocessor 76 sends signals to the outputs A2 and A4, which cause the 4/2-way valves 78 and 79 to be switched over and the cylinder jacket 63 to be raised relative to the piston rod 61 and the piston rod 62 to extend. As a result, the free end of the piston rod 62 is moved from the position (a) shown in FIG. 5 to the position (c). As a result, the two-position cylinder 60 pivots the crank 58 according to FIG. 1, as a consequence of which the projection 68 of the oscillating lever 65, which is in contact with the outer side wall of the adjusting groove 69, is pulled to its inner side wall, and the stitch length adjusting mechanism 71 is thus set for reverse stitching.

Figure 6B:
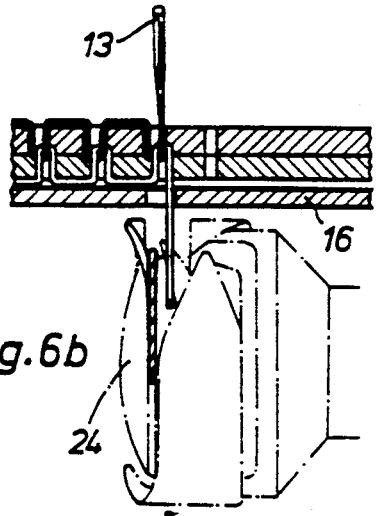

After a fed motion in the reverse direction, a signal is sent from the output ZA 2 of the counter 77 to the input E3 of the microprocessor 76. The needle 13 is then located in its upper reversal point above the penultimate insertion hole of the fabric being sewn (FIG. 6*b*). To stop the needle 13 in this position, the microprocessor 76 sends a signal from its output A9 to the positioning motor 84.

In this position of the needle 13, new shuttle thread is pulled from the bobbin 29 in the case of thread break, and the empty bobbin 29 is replaced with a full one in the case of thread end. After actuating the foot pedal of the sewing machine 1, a signal is sent to the input E4 of the microprocessor 76, after which it sends a signal for reversing the 4/2-way valve 78 from its output A3, so that the cylinder jacket 63 will be extracted. The free end of the piston rod 62 will then assume the position (b) shown in FIG. 5, in which the stitch length regulating mechanism 71 is reset to zero. In position (b), the projection 68 of the oscillating lever 65 is in a position between the inner and outer side walls of the adjusting groove 69.

Figure 6C:
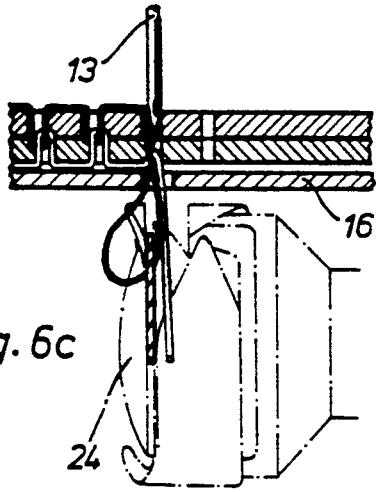

As soon as the stitch length regulating mechanism 71 is reset to zero, a stitch is formed after the microprocessor 76 sends a signal from the output A10. After the needle 13 returns into its upper reversal point, this process can be repeated several times to achieve particularly firm knotting. FIG. 6*c* shows the needle 13 on its way to the upper reversal point.

Figure 6D:
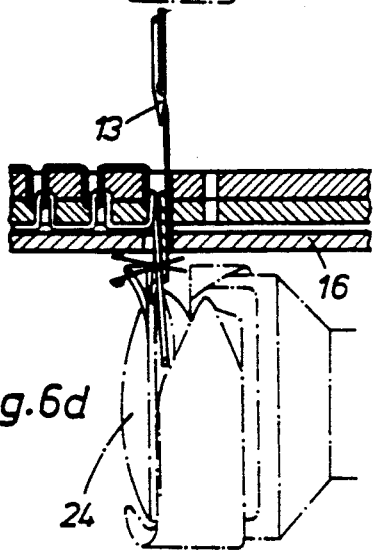
Figure 6E:
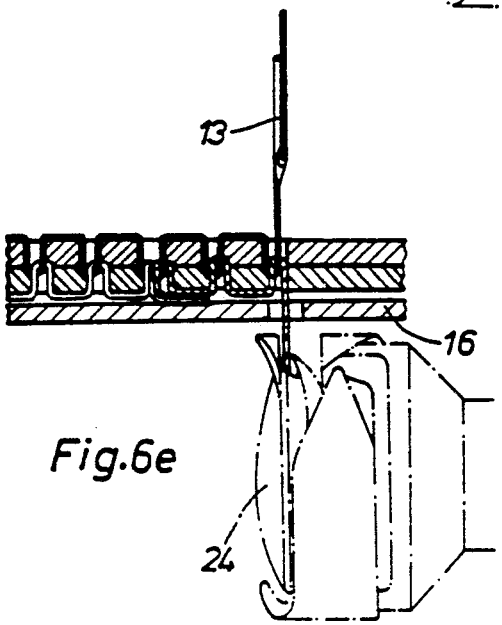

On completion of this knotting, the 3/2-way valve 81 is reversed at the upper reversal point of the needle 13 by a signal sent from the output A6 of the microprocessor 76, so that the piston rod of the cylinder 44 extends and drives the cutting blade 36 to cut the two free ends of the shuttle thread (FIG. 6*d*). The throttle 82 acts to delay the time of reversal of the 3/2-way valve 81, and the throttle 83 acts to reduce the speed of the piston rod during the retraction of the piston.

After the thread has been cut, the microprocessor 76 sends a signal from its output A5 to the 4/2-way valve 79, as a result of which the piston rod 62 is retracted and its free end assumes the position (a) (FIG. 5). The stitch length regulating mechanism 71 is thus again set for forward stitching. By sending a signal from the output All of the microprocessor 76, the positioning motor 84 is again accelerated to the working speed, and stitch formation is continued.

While a specific embodiment of the invention has been shown and described in detail to illustrate the application of the principles of the invention, it will be understood that the invention may be embodied otherwise without departing from such principles.

We claim:

1. A process for forming a seam, which is uninterrupted on a seam side facing the needle of a sewing machine, comprising:

monitoring a shuttle thread for detection of a shuttle thread disturbance;

stopping the sewing machine in a position where the needle is in its bottom position after detection of a shuttle thread disturbance and after a stitch formation cycle which has begun is completed;

setting a stitch length regulating mechanism for reverse stitching;

bringing the sewing machine to a position in which the needle is in its top position;

setting the stitch length regulating mechanism to zero;

forming at least one stitch, subsequent to elimination of the thread disturbance, to knot a new shuttle thread with the needle prior to the appearance of the disturbance; and continuing stitch formation with the original stitch length.

2. A process according to claim 1, wherein subsequent to knotting the new shuttle thread with the needle thread, the free ends of the old and new shuttle thread are cut off.

3. A sewing machine arrangement for formation of a seam, which is uninterrupted on a seam side facing a needle of sewing machine, comprising:

means for detecting a shuttle thread disturbance;

control means for controlling the sewing machine including means for stopping the sewing machine in a position in which the needle is in it bottom position after the appearance of a shuttle thread disturbance and after the stitch formation cycle begun is completed, for setting a stitch length regulating mechanism to reverse stitching, bringing the sewing machine to a position in which the needle is in its top position, for setting the stitch length regulating mechanism to zero, and after elimination of the disturbance, for forming one stitch to knot a new shuttle thread with the needle thread in the insertion hole in which the needle was located prior to the appearance of the shuttle thread disturbance, and subsequently for continuing stitch formation with the original stitch length.

* * * * *